US008266814B2

(12) United States Patent
Grunert

(10) Patent No.: US 8,266,814 B2
(45) Date of Patent: Sep. 18, 2012

(54) METHOD FOR OPERATING A RINSING LIQUID DEVICE IN A HOUSEHOLD APPLIANCE FOR CLEANING PIECES OF LAUNDRY, AND RINSING LIQUID DEVICE

(75) Inventor: Klaus Grunert, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 230 days.

(21) Appl. No.: 12/679,925

(22) PCT Filed: Sep. 24, 2008

(86) PCT No.: PCT/EP2008/062748

§ 371 (c)(1),
(2), (4) Date: Mar. 25, 2010

(87) PCT Pub. No.: WO2009/050003

PCT Pub. Date: Apr. 23, 2009

(65) Prior Publication Data

US 2010/0200018 A1 Aug. 12, 2010

(30) Foreign Application Priority Data

Oct. 12, 2007 (DE) ..... 10 2007 049 060

(51) Int. Cl.
*B08B 3/00* (2006.01)
*F26B 19/00* (2006.01)

(52) U.S. Cl. ..... 34/85; 34/134; 134/90

(58) Field of Classification Search ..... None
See application file for complete search history.

(56) References Cited

U.S. PATENT DOCUMENTS

| | | | | |
|---|---|---|---|---|
| 5,226,203 | A | 7/1993 | Sacconato et al. | |
| 2006/0159519 | A1 * | 7/2006 | Schluter et al. | 405/39 |
| 2006/0179676 | A1 * | 8/2006 | Goldberg et al. | 34/77 |

FOREIGN PATENT DOCUMENTS

| | | | |
|---|---|---|---|
| DE | 3321245 | A1 | 12/1984 |
| DE | 3738031 | A1 * | 5/1989 |
| DE | 10002742 | C1 | 6/2001 |
| DE | 102006006080 | A1 | 8/2007 |
| DE | 102007016074 | A1 | 10/2008 |
| EP | 0731204 | A1 | 9/1996 |

OTHER PUBLICATIONS

English Machine Translation of DE 3738031 A1.*

* cited by examiner

*Primary Examiner* — Michael Kornakov
*Assistant Examiner* — Nicole Blan
(74) *Attorney, Agent, or Firm* — James E. Howard; Andre Pallapies

(57) ABSTRACT

A household appliance for cleaning laundry includes a rinsing container that collects rinsing liquid generated during a cleaning process, a controller that stores a connection type of a rinsing liquid device during an initial commissioning of the rinsing liquid device, and one of a collection container that collects rinsing liquid after cleaning a heat exchanger of a heat pump and a connection to an external waste water system that disposes of the rinsing liquid after cleaning the heat exchanger based upon the connection type stored by the controller.

18 Claims, 1 Drawing Sheet

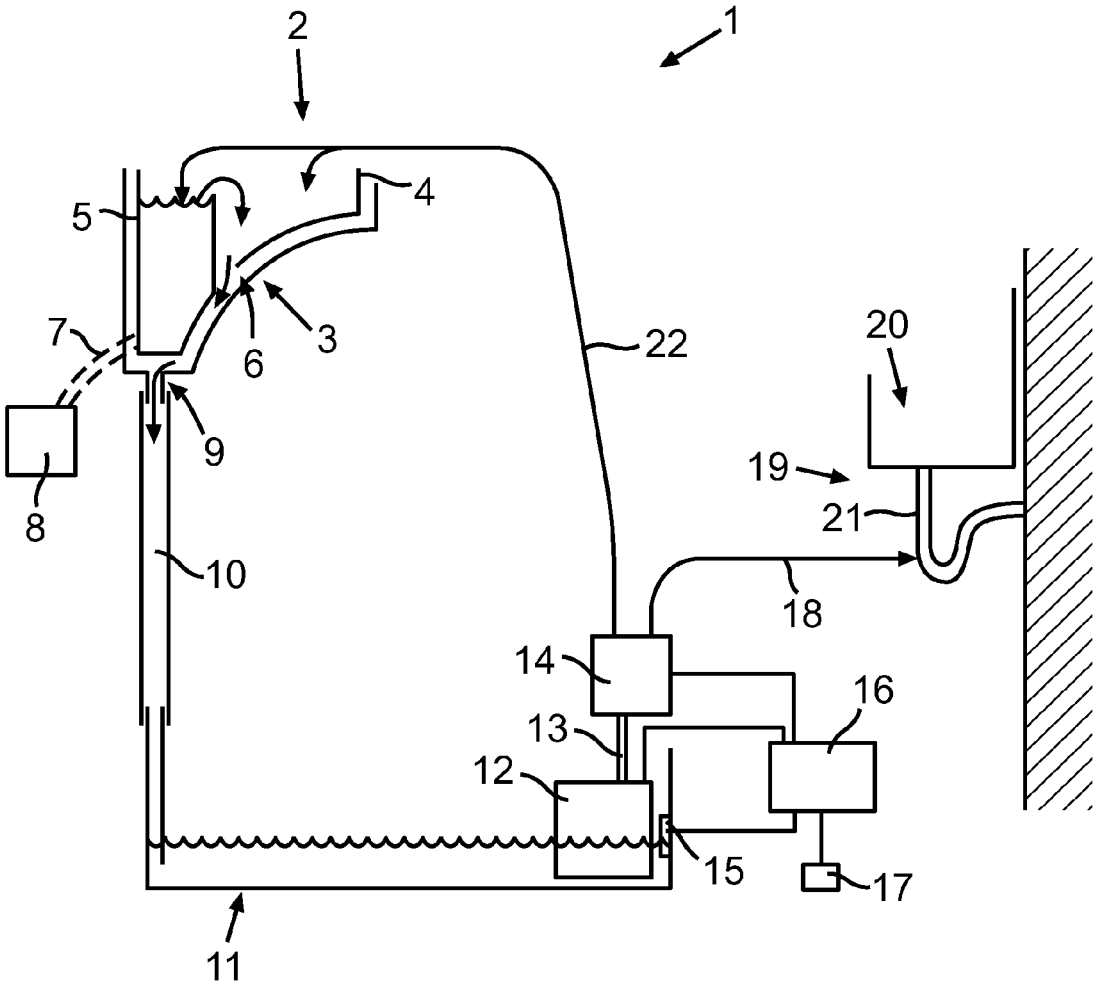
1
2
3
4
5
6
7
8
9
10
11
12
13
14
15
16
17
18
19
20
21
22

METHOD FOR OPERATING A RINSING LIQUID DEVICE IN A HOUSEHOLD APPLIANCE FOR CLEANING PIECES OF LAUNDRY, AND RINSING LIQUID DEVICE

BACKGROUND OF THE INVENTION

The invention relates to a method for operating a rinsing liquid device in a household appliance for cleaning pieces of laundry, wherein the condensate created during a cleaning process is collected as rinsing liquid in a rinsing container, and is guided specific to the operating phase for removing lint from a heat exchanger of a heat pump of the household appliance through said heat pump. The invention further relates to a rinsing liquid device for a household appliance for cleaning pieces of laundry.

A method and household appliance of this type are known from DE 37 38 031 C2. The condensate used for rinsing is finally pumped by means of a pump into an elevated condensate collection container. Instead, it can also be routed into a local waster water pipe.

BRIEF SUMMARY OF THE INVENTION

It is the object of the present invention to create a method for operating a rinsing liquid device and a corresponding household appliance for cleaning pieces of laundry, in which the disposal of the liquid generated during operation of the household appliance can take place in an improved manner specific to the situation.

With the inventive method for operating a rinsing liquid device in a household appliance for cleaning pieces of laundry, a condensate generated during a cleaning process is collected as rinsing liquid in a collection container and is used in a manner specific to the operating phase for removing lint from a heat exchanger of a heat pump of the household appliance and in this respect is guided through the heat exchanger. As a function of a specific connection type of the rinsing liquid device, the rinsing liquid guided through the heat exchanger is then subsequently automatically guided for rinsing liquid disposal purposes into a collection container of the rinsing liquid device or into an external waste water system. Furthermore, with the initial commissioning of the rinsing liquid device, the connection type is initialized and stored in a storage unit of the device and of the household appliance.

As a function of the installation location and the environmental conditions associated therewith, the rinsing liquid device of the household appliance can thus either be connected to an external waste water system, if this is available and the household appliance is correspondingly positioned, or an internal collection of the rinsing liquid in the rinsing liquid device can be ensured if a connection of this type to the waste water system is not possible. With a tumble dryer or washer-dryer comprising a heat pump, a highly-flexible concept for disposing of liquid can be enabled with a rinsing liquid device of this type.

Initial commissioning is understood here to mean the situation in which the rinsing liquid device and thus also the household appliance were in each instance positioned at a new specific location and were to be put into operation there. Since in this context, it must in principle firstly always be clarified whether or not a connection to an external waste water system is possible, it is then also possible, once this point has been clarified, to determine how the further operation is to take place in respect of the liquid disposal. This must then be initialized accordingly before implementing a first cleaning process after the positioning at a new specific location.

The initialization is preferably performed by a specific actuation of at least one control element of the household appliance. Upon initial commissioning, the device controller of a household appliance therefore contains an item of information relating to the connection type selected by the user, with this information being provided by means of a simultaneous or consecutively occurring specific operation. This initialization is predetermined until the connection type is changed by a user and this is in turn initially communicated to the control unit.

The condensate running out of the filled rinsing container is guided into the collection container. The rinsing container is therefore arranged in particular in the collection container such that the collection container is partially used as an overflow chamber for the rinsing container. As a result, a highly functional liquid collection device can be created, which, on the one hand, provides adequate rinsing liquid and yet still also effectively collects the quantity which is not needed such that the further disposal and collection system in the rinsing liquid device, in particular a floor assembly of the household appliance provided for liquid collection purposes and/or the rinsing liquid device, does not overflow.

The rinsing liquid, in other words the condensate collected in the collection container, is preferably guided into a trap of the external waste water system if the rinsing liquid device is connected to the external waste water system. An effective drainage of the condensate and/or rinsing liquid which is no longer needed can herewith take place in simple and uncomplicated manner if a connection of the rinsing liquid device to the external waste water system is provided. The drainage into the trap, which is also arranged under a wash-bowl, can also take place in a space-saving and hygienic fashion.

A closure, in particular a closure arranged on the lowest point in the collection container, of the collection container is opened during the initial commissioning of the rinsing liquid device in order to drain the condensate collected in the collection container, if the rinsing liquid device is connected to the external waste water system for condensate disposal purposes. In particular, this closure is to be opened manually by a user of the device for the first time and this closure then also remains open. As a result, an automatic emptying of the collection container can always be ensured. As a result, this also means that no liquid residues remain in the collection container, which is then particularly advantageous since in the case of a connection type, in which the rinsing liquid device is connected to an external waste water system, the user of the device no longer empties and removes the condensate container, including the rinsing container and the collection container, from the device.

In this respect, allowance can also be made for high hygienic demands.

The rinsing liquid is preferably guided into the collection container after passing through the heat exchanger, if the rinsing liquid device for condensate disposal is not connected to the external waste water system. Even if a compressor heat pump dryer cannot be connected to an external waste water system as a result of the conditions, the collection of the condensate and/or the rinsing liquid which is no longer needed can consequently take place reliably and hygienically. With an embodiment of this type, further to the cleaning process, the condensate container is removed from the rinsing liquid device and the liquid disposal is then carried out by the user of the device.

The rinsing liquid is preferably guided into the floor assembly of the household appliance after passing through the heat exchanger and is automatically guided from there into the external waste water system or collection container as a function of the connection type of the rinsing liquid device.

The fill level increasing in the floor assembly as a result of the inflowing liquid from the rinsing container and the collection container is preferably detected and the liquid collected in the floor assembly is only drained when a fill level threshold value is reached. As a result, an optimal operation of the rinsing liquid device and/or household appliance can be achieved. Furthermore, an overflow of the floor assembly can be effectively prevented. A corresponding sensor system can in particular be provided to detect the fill level.

The rinsing of the heat exchanger is preferably carried out at least twice, with, after the first rinsing process, the rinsing liquid guided through the heat exchanger being guided back into the rinsing container and the rinsing liquid only being guided into the collection container or into the external waste water system after the last rinsing cycle, as a function of the connection type of the rinsing liquid device. The efficiency of the rinsing process can be improved by the repeated use of the rinsing liquid and the disposal of the then no longer needed rinsing liquid and condensate can then be effectively ensured.

The liquid collected in the floor assembly is preferably pumped into the rinsing container until the number of rinsing cycles is terminated and the liquid collected in the floor assembly after rinsing the heat exchanger is pumped into the traps of the waste water system once the fill level threshold value in said floor assembly has been reached, if the rinsing liquid device for condensate disposal is connected to the waste water system. This procedure also contributes to optimizing the rinsing and disposal cycles, particularly in the case of a compressor heat pump dryer.

With an inventive household appliance for cleaning pieces of laundry comprising a rinsing liquid device, with which condensate created during a cleaning process can be collected as rinsing liquid in a rinsing container, and guided specific to the operating phase for removing lint from a heat exchanger of a heat pump of the household appliance through said heat pump, the rinsing liquid guided through the heat exchanger is automatically guided into a collection container of the rinsing liquid device or into an external waste water system for liquid disposal purposes as a function of a specific connection type of the rinsing liquid device and with the initial commissioning of the rinsing liquid device, the connection type can also be initialized and stored in a control unit.

This embodiment of the device enables a highly flexible system for rinsing the heat pump of the household appliance on the one hand and for disposing of the liquid which is no longer needed on the other hand.

The condensate can preferably be collected in a rinsing container of the rinsing liquid device, which is arranged at least in regions in the collection container such that the liquid overflowing from the rinsing container automatically runs into the collection container.

BRIEF DESCRIPTION OF THE DRAWINGS

Advantageous embodiments of the inventive method are to be seen as advantageous embodiments of the inventive household appliance.

An exemplary embodiment of the invention is described in more detail below with reference to a schematic drawing. The single FIGURE shows a household appliance for cleaning pieces of laundry with a rinsing liquid device.

DETAILED DESCRIPTION OF EXEMPLARY EMBODIMENTS OF THE PRESENT INVENTION

The household appliance for cleaning pieces of laundry is a compressor heat pump dryer, which is referred to below as a dryer 1. The dryer 1 includes a rinsing liquid device 2 with a condensate container 3. The condensate container 3 includes a collection container 4 and a rinsing container 5 arranged therein. The rinsing container 5 is positioned in the collection container 4 such that if the rinsing container 5 overflows, overflowing liquid automatically runs into the collection container 4.

A closure 6 is embodied on the lowest point in the collection container 4. The rinsing container 5 includes an outlet, on which a pipe 7 is arranged, which leads to a heat exchanger 8. The heat exchanger 8 is assigned to the heat pump of the dryer 1.

A support 9 is arranged on the lower end of the condensate container 3, on which a recirculating hose 10 is fastened. This recirculating hose 10 opens into a floor assembly 11 of the rinsing liquid device 2 and/or dryer 1. Furthermore, a pump 12 is arranged in the floor assembly 11, which is connected via a pipe 13 to a valve 14, in particular a magnetic valve. Furthermore, a sensor 15 for detecting the fill level of the liquid in the floor assembly 11 is arranged in the floor assembly 11. The pump 12, the valve 14 and the sensor 15 are connected to an electronic control unit 16. Furthermore, the control unit 16 is connected to a control unit 17 of the dryer 1, with the control unit 17 preferably comprising several control elements.

In the embodiment shown, an external waste water system is present in direct proximity to the installation site of the dryer 1 and thus also the rinsing liquid device 2. The magnetic valve 14 is therefore connected by way of a pipe 18 to a trap 21 of the external waste water system 19. The trap 21 is arranged below a wash-bowl 20. Furthermore, the rinsing liquid device 2 has a pipe 22 from the valve 14 to the collection container 4 on the one hand and to the rinsing container 5 on the other hand.

The mode of operation of the dryer 1 and the rinsing liquid device 2 is explained below. The dryer 1 is mounted on its installation site directly adjacent to the wash-bowl 20 and the trap 21. This is enabled as a result of the local conditions in the building, in particular the flat or a house.

The user of the dryer 1 therefore connects the pipe 18 on the trap 21 and a connection type is thus selected, whereby the rinsing liquid device 2 is connected to the external waste water system 19.

This connection type is initialized so as to also communicate this to the dryer 1 and to the rinsing liquid device 2 so that they continue to operate in respect of the liquid disposal. To this end, a specific actuation of at least one control element of the control unit 17 is implemented prior to the first commissioning of the dryer 1 and after connection of the pipe 18 to the trap 21. The control unit 16 identifies the connection type by means of this specific actuation type. This information is stored in the control unit 16, in particular a storage unit of the control unit 16 and is used as the basis of the further mode of operation until a new initialization is carried out.

By the connection type to the external waste water system 19 having been selected by the user of the dryer 1, with the following cleaning process, the rinsing liquid which is no longer needed after the rinsing process of the heat exchanger 8 and the condensate collected in the collection container 4 is automatically drained via the floor assembly 11, the pump 12, the pipe 13 and the valve 15 through the pipe 18 into the trap 21.

If the dryer is brought into operation after the indicated connection and initialization and a corresponding cleaning process is implemented, a condensate is generated during these operations, which is firstly guided into the rinsing container 5. If in this context the generated condensate quantity exceeds the holding capacity of the rinsing container 5, this automatically overflows and the overflowing condensate is collected in the collection container 4 and/or flows via the closure 6 and the recirculating hose 10 into the floor assembly 11. In this case the closure 10 is manually opened by the user before the initial commissioning.

The condensate collected in the rinsing container 5 is then, specific to the operating phase, guided through the heat exchanger 8 as a rinsing liquid for said heat exchanger 8 in order to be able to remove the lint collected in the heat exchanger 8. The rinsing liquid escaping from the heat exchanger 8 is then likewise guided into the floor assembly 11 and collected there.

If the rinsing process for the heat exchanger 8 is provided such that it is not only one cycle that is provided with rinsing liquid, but at least two rinsing cycles are to occur, the liquid collected in the floor assembly 11 is pumped back into the rinsing container 5 via the pump 12, the pipe 13, the valve 14 and the pipe 22.

Once the repeated cycle of the rinsing liquid through the heat exchanger 9 is ended and thus also the rinsing process is ended, the liquid collected in the floor assembly 11 is then no longer pumped back into the rinsing container 5. This whole cycle is in this case controlled by way of the control unit 16. With the last cycle of the rinsing liquid through the heat exchanger 8, the rinsing process is then also concluded, this being detected by the control unit 16.

Furthermore, the liquid is then drained out of the floor assembly 11 via the pipe 18 into the trap 21 after a fill level threshold value has been reached in the floor assembly 11, which is detected by the sensor 15.

With a connection type shown in FIG. 1 with a direct connection to the external waste water system 19, it can also be ensured that the rinsing container 5 and in particular also the collection container 4 are always empty at the end of the cleaning process, since the collection container 5 is completely emptied by way of the opening on the closure 6 and no condensate residues can thus remain therein. The condensate container 3 therefore no longer needs to be removed by the user of the dryer 1 to for cleaning or emptying purposes.

On account of the embodiment of the condensate container 3 with the collection container 4 and the rinsing container 5 arranged therein, an effective overflow functionality can be ensured, as a result of which the restricted intake capacity of the floor assembly 11 can also be taken into account.

If the dryer 1 is arranged at a location where a direct connection to the external waste water system 19 is not possible and thus the pipe 18 cannot be realized, this is also to be initialized before the initial commissioning. This can be done using a procedure similar to the one described above.

By contrast with the liquid disposal explained for illustration purposes in the FIGURE, with a connection type of this type, after the rinsing process has been concluded, the liquid collected in the floor assembly 11 is pumped into the collection container 4 by way of the pipe 22. With a connection type of this type, without a direct connection to the external waste water system 19, the closure 6 is closed. At the end of the cleaning process, the condensate container 3 is then to be removed from the rinsing liquid device 2 and thus also from the dryer 1, and a corresponding disposal is to be carried out.

The invention claimed is:

1. A household appliance for cleaning laundry comprising:

a rinsing liquid device including a collection container and a rinsing container contained therein that collects rinsing liquid generated during a cleaning process and guides the rinsing liquid through a heat exchanger of a heat pump; and a controller that stores a connection type information of the rinsing liquid device during an initial commissioning of the rinsing liquid device, wherein the controller is configured to cause automatic disposal of the rinsing liquid guided through the heat exchanger into one of the collection container and an external waste water system based upon the connection type stored information by the controller.

2. The household appliance of claim 1, wherein liquid overflowing from the rinsing container automatically runs into the collection container.

3. The household appliance of claim 1, further comprising:

a floor assembly in communication with the collection container and the external waste water system, the floor assembly configured to collect the liquid drained from the collection container.

4. The household appliance of claim 1, wherein the lowest point of the collection container has a closure configured for one of:

movement to an open position during the initial commissioning of the rinsing liquid device in order to drain the liquid collected in the collection container if the rinsing liquid device is connected to the external waste water system; and movement to a closed position during the initial commissioning of the rinsing liquid device if the rinsing liquid device is not connected to the external waste water system.

5. A household appliance for cleaning laundry comprising:

a rinsing liquid device including a collection container and a rinsing container contained in the collection container, the rinsing container configured to collect liquid generated during a cleaning process and also positioned in the collection container such that overflowing liquid therein automatically flows into the collection container;

a heat exchanger of a heat pump in communication with the rinsing container such that the liquid in the rinsing container is guiding therethrough to clean the heat exchanger;

a controller that stores a connection type information of the rinsing liquid device during an initial commissioning of the rinsing liquid device;

a floor assembly in communication with the collection container and which collects the liquid used to clean the heat exchanger; and a sensor connected to the controller and which detects a fill level of the liquid collected in the floor assembly such that the controller initiates automatic draining of the liquid in the floor assembly when a fill level threshold value is reached.

6. The household appliance of claim 5, further comprising:

an external waste water system in communication with the floor assembly.

7. The household appliance of claim 6, wherein, based upon the connection type stored by the controller, the rinsing liquid guided through the heat exchanger is subsequently automatically guided for rinsing liquid disposal purposes from the floor assembly into one of:

the collection container; and the external waste water system.

8. The household appliance of clam 5, wherein the sensor is provided in the floor assembly.

9. A method for operating a rinsing liquid device in a household appliance for cleaning pieces of laundry, the rinsing liquid device including a collection container and a rinsing container contained therein, the method comprising:

storing, in a controller, a connection type information of the rinsing liquid device during an initial commissioning of the rinsing liquid device;

collecting condensate generated during a cleaning process as rinsing liquid in the rinsing container;

guiding the condensate, from the rinsing liquid device through a heat exchanger of a heat pump, to an operating phase for removing lint from the heat exchanger of the heat pump; and automatically disposing the rinsing liquid guided through the heat exchanger into one of the collection container and an external waste water system based upon the connection type information stored in the controller during the initial commissioning of the rinsing liquid device.

10. The method of claim 9, further comprising initializing commission of the rinsing liquid device by specifically actuating a control element of the household appliance.

11. The method of claim 10, further comprising opening a closure on a lowest point in the collection container during the initializing commission to drain condensate collected in the collection container if the rinsing liquid device is connected to the external waste water system for condensate disposal purposes.

12. The method of claim 9, further comprising overflowing condensate out of a filled washing container into the collection container.

13. The method of claim 9, wherein the guiding of the rinsing liquid comprises guiding rinsing liquid and condensate collected in the collection container into a trap of the external waste water system if the rinsing liquid device is connected to the external waste water system.

14. The method of claim 9, wherein the guiding the rinsing liquid comprising guiding the rinsing liquid into the collection container after passing through the heat exchanger if the rinsing liquid device is not connected to the external waste water system for liquid disposal purposes.

15. The method of claim 9, further comprising guiding the rinsing liquid into a floor assembly of the household appliance after passing through the heat exchanger before guiding into the external waste water system or the collection container as a function of the connection type of the rinsing liquid device.

16. The method as claimed in claim 15, further comprising detecting a fill level increasing in the floor assembly as a result of the inflowing liquid from the rinsing container and the collection container and draining the liquid collected in the floor assembly only when a fill level threshold value is reached.

17. The method of claim 16, further comprising pumping the rinsing liquid collected in the floor assembly until a number of rinsing cycles is terminated.

18. The method of claim 9, further comprising:

rinsing the heat exchanger a first time;

guiding the rinsing liquid back into the rinsing container; and rinsing the heat exchanger a second time before the guiding of the rinsing liquid into one of the collection container and the external waste water system.

* * * * *